US007909051B2

(12) United States Patent
Victory et al.

(10) Patent No.: US 7,909,051 B2
(45) Date of Patent: Mar. 22, 2011

(54) ROTARY CLOTHES LINE COVER

(75) Inventors: Malcolm Gordon Victory, Malvern Wells (GB); Guy Darell Unwin, Longdon (GB); Gail Lobb, Kidderminster (GB)

(73) Assignee: Malcolm Gordon Victory (GB)

( * ) Notice: Subject to any disclaimer, the term of this patent is extended or adjusted under 35 U.S.C. 154(b) by 0 days.

(21) Appl. No.: 12/300,039

(22) PCT Filed: May 15, 2005

(86) PCT No.: PCT/GB2007/001826

§ 371 (c)(1), (2), (4) Date: Nov. 7, 2008

(87) PCT Pub. No.: WO2007/132251

PCT Pub. Date: Nov. 22, 2007

(65) Prior Publication Data

US 2009/0134104 A1 May 28, 2009

(30) Foreign Application Priority Data

May 16, 2006 (GB) ..... 0609633.3

(51) Int. Cl.
*E04H 15/26* (2006.01)
*D06F 57/04* (2006.01)

(52) U.S. Cl. ..... 135/98; 135/96; 135/119; 135/33.2; 211/197

(58) Field of Classification Search ..... 135/98–99, 135/115, 119, 33.2, 33.7, 96, 33.4; 211/193, 211/195–197, 180, 85.24, 119.12; 160/348
See application file for complete search history.

(56) References Cited

U.S. PATENT DOCUMENTS 1,516,372 A * 11/1924 Brooks ..... 135/98
2,015,321 A * 9/1935 Shelton ..... 135/98

(Continued)

FOREIGN PATENT DOCUMENTS

AU 5069693 A 6/1994

(Continued)

OTHER PUBLICATIONS

International Search Report for corresponding PCT application No. PCT/GB2007/001826.

(Continued)

*Primary Examiner* — Winnie Yip
(74) *Attorney, Agent, or Firm* — Heslin Rothenberg Farley & Mesiti P.C.

(57) ABSTRACT

According to the present invention, there is provided a cover (11) for an outdoor clothes airer (10) having at least three radially-extending arms (2) supporting an array of clothes lines (7), the cover comprising a sheet (3) of waterproof material which is resistant to ultra-violet rays and dimensioned to extend radially beyond the ends of said radial arms above the clothes lines, arranged to drain outwards, and provided with a central supporting means (16) and a peripheral tensioning means (5) such as a drawstring or plurality thereof for securing the sheet to the airer and a circumferential skirt (6) of an air permeable netting material finished with a weighted hem (9). Access to the laundry contained within the invention is easily achieved by lifting a side or sides of the circumferential skirt and laying it or them on top of the cover sheet, after which the laundry may be laced within the skirt of removed therefrom and the skirt may be let down again.

14 Claims, 2 Drawing Sheets

U.S. PATENT DOCUMENTS

| | | | | | |
|---|---|---|---|---|---|
| 2,146,517 | A | * | 2/1939 | Thompson | 135/98 |
| 2,503,386 | A | * | 4/1950 | Griffin | 211/197 |
| 2,661,849 | A | * | 12/1953 | Van Spalding | 211/2 |
| 3,419,024 | A | * | 12/1968 | Nickerson, Jr. | 135/98 |
| 3,477,453 | A | * | 11/1969 | Ulisse et al. | 135/95 |
| 4,488,565 | A | * | 12/1984 | Smith | 135/100 |
| 4,817,654 | A | * | 4/1989 | Christensen | 135/90 |
| 5,172,712 | A | * | 12/1992 | Robinson | 135/98 |
| 5,664,595 | A | * | 9/1997 | Vonderhorst et al. | 135/16 |
| 5,678,587 | A | * | 10/1997 | Bilotti | 135/98 |
| 5,930,948 | A | * | 8/1999 | Daniel | 47/23.1 |
| 6,009,891 | A | * | 1/2000 | Surface et al. | 135/98 |
| 6,877,521 | B2 | * | 4/2005 | Webster et al. | 135/99 |
| 2007/0125409 | A1 | * | 6/2007 | Cullen | 135/33.41 |

FOREIGN PATENT DOCUMENTS

| | | | | |
|---|---|---|---|---|
| DE | 8716899 | U1 | | 2/1988 |
| DE | 4128197 | A1 | | 2/1993 |
| EP | 475668 | A1 | * | 3/1992 |
| EP | 1632599 | A1 | | 8/2006 |
| GB | 1599641 | A | | 10/1981 |
| GB | 2109678 | A | | 6/1983 |
| GB | 2210260 | A | * | 6/1989 |
| GB | 2224432 | A | | 9/1990 |
| GB | 2247401 | A | * | 3/1992 |
| GB | 2263395 | A | | 7/1993 |
| GB | 2265165 | A | * | 9/1993 |
| GB | 2306308 | A | | 7/1997 |
| GB | 2336527 | A | * | 10/1999 |
| GB | 2346320 | A | * | 8/2000 |
| GB | 2352168 | A | | 1/2001 |
| GB | 2360699 | A | | 10/2001 |
| GB | 2378381 | A | * | 2/2003 |
| GB | 2379601 | A | * | 3/2003 |
| GB | 2406268 | A | * | 3/2005 |
| GB | 2406508 | A | * | 4/2005 |
| GB | 2438161 | B | | 12/2009 |

OTHER PUBLICATIONS

Written Opinion for corresponding PCT application No. PCT/GB2007/001826.

Examination Report for corresponding GB application No. GB06096333 dated Mar. 25, 2009.

* cited by examiner

ROTARY CLOTHES LINE COVER

CROSS-REFERENCE TO RELATED APPLICATIONS

This application is a §371 filing of PCT application PCT/GB2007/001826 filed on May 15, 2007, which claims priority from British application GB0609633.3 filed on May 16, 2006. The disclosures of these applications are included by reference herein in their entirety.

BACKGROUND

1. Field of the invention

This invention relates to a cover to keep washing dry which is suitable for all existing rotary clothes line airers.

2. Description of Related Art

In searches it was found that there were many examples of prior art for the current application, which arises from the need to protect washed clothes from wetting by further rainfall while drying on an outdoor line. In addition, laundry hung outside to dry is subject to degradation as a result of accumulated dirt on the line and by soiling due to birds, which also is obviated by the provision of a cover. Despite the problems of outdoor drying it is generally felt that there is a superior quality to laundry dried in open air. Due to restrictions on space for many households, the rotary airer type of washing line is extremely popular, and lends itself well to the superimposition of a waterproof cover that will prevent ingress of falling water onto the clothes hung upon the airer. Many working housewives find that in the British climate they cannot predict whether the laundry put out in the morning will actually dry by the evening, or will be wetter than before. Then they are forced either remove the washing while wet or leave it in place uncertain whether the next day will be dry enough.

Clothing dried in direct sunlight is also subject to bleaching due to the action of ultra violet rays, a problem that the present invention seeks to ameliorate. The main alternative to drying laundry outdoors is to use a tumble drier or similar electrically heated device to dry the laundry indoors. Apart from the drawbacks inherent in this method of drying laundry, ecological and economic factors now weigh against this method of drying, in that the cost of electricity is increasing quickly, and huge national economies could be achieved if this method were replaced by the method using the current invention. The fossil fuels spent in generation would be preserved and the pollution produced thereby would also be avoided.

The existing similar published Patent applications are frequently limited in scope, impractical, clumsy in use or expensive to manufacture. The number of applicants who have been deterred from pursuing the idea due to prior art is extremely high, many applications lapsing as soon as the searches are received. The majority of applications provide for a rigid structure to be mounted upon the existing airer involving additional weight, expense and complexity. They tend to entrain air within the canopy and skirt causing condensation and poor drying ability, are often unstable even in moderate winds. For these reasons, many are likely to cause the central shaft of the rotary airer to either deform or detach itself from its base. Without the ability of the air to circulate, the clothes are unable to dry as quickly or as freshly as in free air. Furthermore the materials selected are often designed to maximize the insulation of the laundry in order to increase the rapidity of the drying process with the resultant problem that the washing is as bleached by the effect of ultra violet light as it would be in the open air.

Many applications apply only to three-armed rotary airers, while others apply only to four-armed rotary airers. Frequently the application will provide for a structure to be superimposed onto the central shaft or the arms of the airer and of these inventions some apply to a convex structure which drains to the peripheral edge or surface of the invention while others apply to concave structures which drain to the centre of the invention. In several cases the cover is arranged as a series of panels to allow air to flow through, while others have vents or large central apertures in conjunction with a separate hood or baffle to prevent rain falling on the laundry. Several different means of attachment are featured, the majority of which depend on location of the radial arms within the corners of the cover, and external lateral surfaces, sheets or skirts in a wide variety of forms are provided in the majority of applications.

In the recently terminated application GB2369045 DAY there is presented a centrally raised tent structure located at its centre on top of an additional pole extension and at the extremities of the radial arms of the airer itself. As with the present application and sundry other filed Patent Applications the cover forms a convex upper surface. However, in the current application, the cover is applied directly to the extremities of the radial arms and secured by means of a drawstring or strings with or without the provision of elastic reinforcement, and features a skirt with a weighted hem, whereas DAY provides for apertures in the canopy to accommodate special end pieces for the arms of the airer amongst other distinguishing features.

GB2109678 FEILDEN provides for a concave cape with waterproof sides attached at its corners in either square or triangular form but without the provision of a drawstring means to allow for variations in size of existing airers, while GB2352168 COLLINS provides for a rigid structure to bear the weight of the cover, attached above the airer itself, being square in plan and formed of heavyweight waterproof material and tethered to the ground. GB2369562 ROOKE also provides for a rigid structure supervening above the existing airer frame. GB2061719 PENROSE provides for a convex polygonal cover attached at the ends of the radial arms without provision for any lateral protection from the rain or means for drainage. In GB2336527 MARTIN there is provided a cover inducing negative pressure to cause airflow through the laundry, but which is formed of an individually attached cover and impermeable side panels to create the "venturi effect." This configuration is likely to suffer or fail in conditions of high wind due to the wind resistance inherent in its design. GB2376626 ROUSE provides for a circular transparent cover attached by pegs to the distal lines of the rotary airer whereas in practice such a cover would require to be tensioned around the ends of the radial arms. These are a few more relevant applications of many discovered in the Prior Art. It is the aim of the present invention to provide a solution to the problem that so many different configurations have attempted to address, and that is simple both to manufacture and to use.

BRIEF SUMMARY OF ASPECTS OF THE INVENTION

According to the present invention there is provided a cover for an outdoor clothes airer having at least three radially-extending arms supporting an array of clothes lines, the cover comprising a sheet of waterproof material which is resistant to ultra-violet rays and dimensioned to extend radially beyond the ends of said radial arms above the clothes lines, arranged to drain outwards, and provided with a central supporting means and a peripheral tensioning means such as a drawstring or plurality thereof for securing the sheet to the airer and a circumferential skirt of an air permeable netting material finished with a weighted hem. Access to the laundry contained within the invention is easily achieved by lifting a side or sides of the circumferential skirt and laying it or them on top of the cover sheet, after which the laundry may be placed within the skirt or removed therefrom and the skirt may be let down again. The material forming the central portion of the invention may be of any material which provides water resistance and which ideally is resistant to Ultra Violet radiation. However, in practice an impermeable polypropylene or polyethylene weave, raffia material or nylon suitably treated will provide the durability and lightness required for the purpose. The corner points of the cover sheet should be reinforced by second or further layers of material. The central portion of the material forming the cover will also ideally be reinforced by second or further layers of material or of other material. The cover sheet of the invention is also provided with a central supporting means comprising a length of rigid material such as steel, UPVC (unplasticised polyvinyl chloride) or other suitable plastic in order that the cover sheet may be so raised at its centre and thus drain outwardly. This central support may additionally be furnished with means of adjusting its vertical height to assist in tensioning the cover sheet upon the airer and will usually be tubular or cylindrical in form.

Outdoor Airers normally feature a plastic cap at the upper end of the central post to prevent ingress of water. This may be removed to accommodate the central support of the present invention. The central support may be fashioned in a variety of ways, but the preferred forms comprise a tubular form that fits within the shaft of the airer at its upper extremity either with or without a taper on its outer surface such that the outer diameter of the central support reduces towards its lower end, thus enabling a tightly conforming fit with a wide variety of sizes of central shaft of the airer. An alternative arrangement is to provide a stepped profile to the support at its lower end in place of the taper. The central support may equally be of a lesser or greater diameter than the central shaft of the airer throughout its length and furnished with a range of holes of the same diameter disposed diametrically opposite each other, lineally along said central support. In this case a peg is provided to penetrate through both sides of the central shaft to locate the central support and adjust its height relative to the central shaft of the airer. In this simple form without a tapered or stepped profile, it can be set to a variety of heights within the central shaft of the airer to support the cover sheet at the correct tension, whereas in either tapered or stepped profile variations it will be necessary either to provide a support of a fixed length or to provide a similar range of holes to raise or lower a second central support member that fits within the tapered or stepped shaft which is similarly equipped with holes and is then pegged at the appropriate height. Known alternatives to the 'hole and peg' method of adjustment may be utilised, which include a releasable collar that adjusts the height of the central support in order to tension the cover appropriately.

By providing a peripheral channel in the material at or near its outer edge, within which is positioned a cord with two loose ends revealed to the exterior of the channel to form a drawstring, differences in diameter and form can be accommodated to make the invention applicable to a wide range of existing airers. A further improvement is to provide a plurality of drawstrings to facilitate the tensioning process of the cover sheet. It has been found that the radial arms of existing airers range from 900 to 1600 millimeters radius, with the majority falling in the region of 1300 to 1400 millimeters. Larger and smaller spans may be accommodated within the scope of the invention by increasing or decreasing the size of the cover sheet. The present invention may be produced in a variety of shapes and sizes to cover the range of airers existent at any time now or in the future. Said airers are usually rated in terms of their linear capacity, a triple armed version being at the lower end of the scale at 38 meters (903 mm radius) while four armed versions range from 40 to 60 meters (1250 mm to 1585 mm).

In place upon the rotary airer, dependent from the external edge of the cover below said drawstring is a skirt made of a netting or mesh. The purpose of said skirt is to prevent rain falling at an angle onto the outer garments on the airer. Experiments have proved that a loose weave material as now described will deflect all but the most fiercely driven rain. Said skirt may be of any depth but will usually be within the range of 700 to 1000 millimeters deep, this depth having been found to be the optimum practical balance between protection and ease of use. Said netting should ideally be lightweight and both water and ultra-violet resistant, of a loose weave with a mesh size of between 1 millimeter and 5 millimeters, although any practicable fabric may be utilised within the scope of the invention. In order to prevent excessive movement of such a light fabric in the wind the netting skirt will require to be weighted. A weighted circumferential hem may be provided to give solidity to the skirt and to prevent the wind from blowing the loose fabric against the drying laundry contained within, or otherwise weights may be provided to attach to the skirt as required. Said skirt may equally be fashioned in segments and may be weighted by other means, e.g. by self-adhesive, pocketed or hooked weights. If desired it may be tethered by means of guy ropes extending from the distal ends of the radial arms within said skirt, or from attachments at the lower edge of said skirt to ground spikes or pegs in the manner of a tent for added security in bad weather. In certain cases it may be desirable to replace or supplement the drawstring or drawstrings hereinbefore mentioned with one or more lengths of elastic similarly arranged to facilitate attachment of the cover to the rotary airer.

In order to prevent the risk of wind tearing the cover from the airer, vents may be provided in or upon the cover sheet to permit the reduction of pressure thus relieving any upward forces on the cover sheet. These may be provided in any form, being in the simplest form a slit or plurality of slits in the cover sheet. A preferred option is to form an aperture or apertures horizontally in the cover sheet, over which a patch of material is sewn or welded on the upper and side edges, with the lower side left open to permit ventilation of the interior space of the cover sheet. Preferably pleated gussets may be provided at both sides to vary the aperture for ventilation as required in response to the prevailing wind. As a further precaution, securing means may be applied to the cover sheet to prevent it flying away or being lost if torn from the airer by a sudden gust of strong wind. Ideally said means will be in the form of a tie or ties connecting the cover sheet by knots or hooks to the arms or central pole of the airer, and will allow the cover to become detached from the airer without damage while retaining the cover attached in at least one place to the airer. However, in view of the force that severe wind can place on the airer and its cover, it is advisable to remove the invention from the airer for storage during stormy weather.

It may be found practical to extend the material of the cover sheet vertically below the drawstring means. It may also be found desirable to incorporate vertical strips of heavier material into the skirt, either to provide increased stability of the skirt in high wind or in the form of a plurality of vertical flaps forming Vee-shaped strips as viewed from above, all attached in identical orientation around the skirt with either right or left hand edges open in order to catch the wind and drive the rotary airer round in either a clockwise or anti-clockwise direction respectively.

A reinforcing strip or patches of fabric may be attached within the cover sheet to strengthen the cover sheet where it is in contact with the airer. If desired, protective items (hereinafter referred to as protectors) may be separately or integrally furnished to overlay the ends of the radial arms thus reducing any wear to the cover where it rests on said ends. The protectors may be of any form or known means such that the point load upon the material is diminished, e.g. sheets of durable plastic which deform to accommodate the ends of the radial arms, balls of sponge-like plastic, rigid hemispheres equipped with a central recess to attach over the ends of the arms, patches of reinforcing material etcetera. In tropical countries it is sometimes prudent to prevent access of insects to the laundry, such as the Putsi fly in Zimbabwe and other parts of Africa. This particular insect lays its eggs in moist sand, earth or laundry; the eggs later hatching into maggots which burrow under the skin of a warm blooded host such as a human being. These later hatch and emerge from the skin, by which time serious infection has set in. As a result it is the custom to have all laundry ironed to prevent or limit the possibility of the eggs hatching from the laundry when an article of clothing is worn. This uses energy in a wasteful manner, as referred to above, and an embodiment of the present invention therefore includes the provision of a skirt that reaches the ground, and guy ropes 20 and pegs 21 together with a zipped or otherwise insect-proof opening 22 for access to the interior.

In the following drawings it is not intended to exclude features from another Figure from each specific embodiment but rather to provide a basis for their combination in specific applications. While the invention has been disclosed in its preferred form, it is to be understood that the specific embodiments thereof, as described and illustrated herein, are not to be considered in a limited sense, as there may be other forms or modifications of the invention which should also be construed to come within the scope of the appended claims.

BRIEF DESCRIPTION OF THE DRAWINGS

Specific embodiments of the invention will now be described by way of example with reference to the accompanying drawings in which.

DETAILED DESCRIPTION OF ASPECTS OF THE INVENTION

Figure 1:
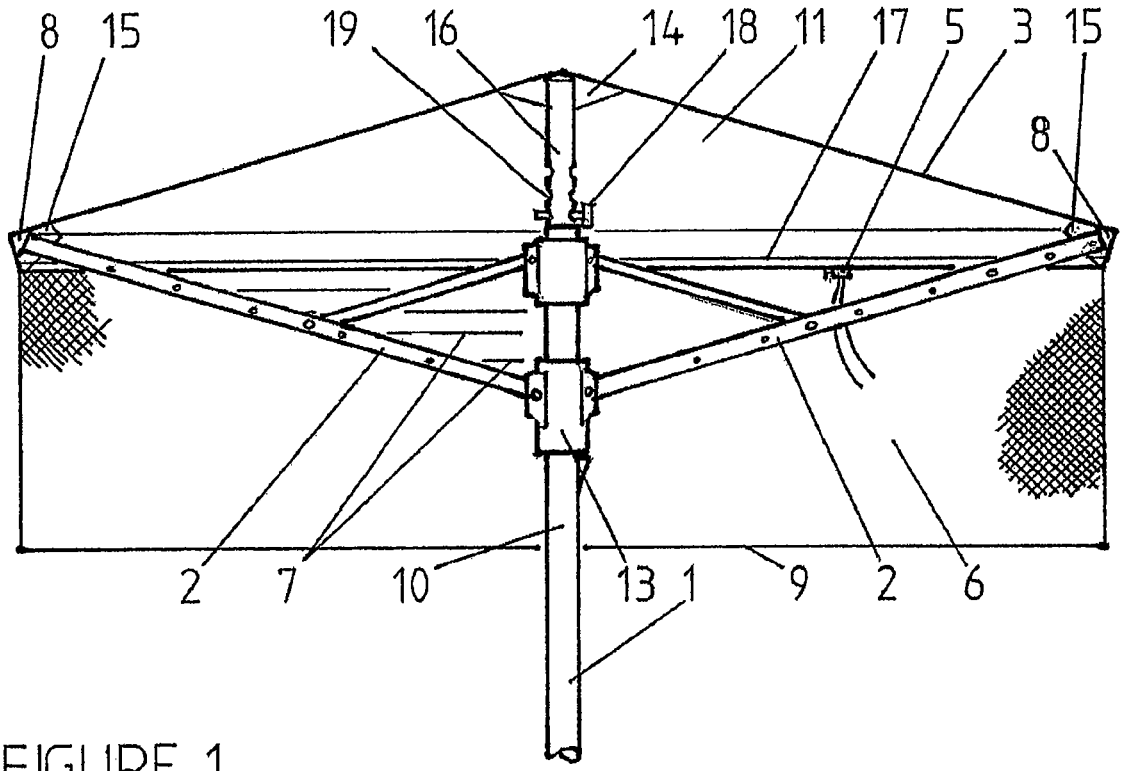
FIG. 1 shows a section along the diagonal centreline of the rotary airer demonstrating the essential features of the invention.

Referring to the drawings, FIG. 1 shows the cover 11 in place upon a typical four-armed rotary airer 10. The arrangement upon a triangular rotary airer is identical but for the fact that the cover sheet 3 is shaped as a triangle. The drawstring means 5 will draw the outer edge of the cover sheet 3 inward in the same way. At the present date there are no airers made with more than four arms, but five- or six armed airers are possible, and the invention could equally conform to such alternative configurations. The rotary airer 10 has the main features of central shaft 1, radial arms 2 and lines 7, over which is draped the cover 11 composed of cover sheet 3, drawstring 5, mesh or netting skirt 6, protectors 8 and weighted hem 9. The central supporting means 16 attaches to top of the central shaft 1 in order to raise the cover sheet 3 enabling said cover sheet 3 to drain outwards. The invention is shown in the raised position, but if it is desired to fold the airer when not in use by lowering the collar 13 bearing the radial arms 2 downwards on the central shaft 1, the cover 11 may be left in place to keep the lines 7 clean, or removed in clement weather if so desired. For the sake of clarity, washing lines 7 are only partially indicated. It may also be desirable in certain cases to replace or supplement said drawstring or drawstrings 5 with one or more lengths of elastic similarly displayed to facilitate attachment of the cover 11 to the rotary airer 10. The cover sheet 3 is ideally fashioned of waterproof material resistant to ultra-violet radiation and is held in place by a peripheral drawstring or drawstrings 5 that is slidably located within a peripheral track or channel defined by a seam or plurality of seams in the material of the cover 11 which may be tensioned to suit the individual rotary airer 10. Said drawstring or drawstrings 5 may be supplemented or replaced by one or more elastic strips similarly arranged. The central portion 14 of the cover sheet 3 should ideally be reinforced as hereinbefore described. The cover sheet 11 is supported by a central support 16 as hereinbefore mentioned, arranged to fit co-operatively with the central shaft 10 of the airer 1, and adjusted to the correct height in this case by means of a peg 18 and a range of holes 19, although other known means such as a releasable collar or a support of a fixed length may be utilised.

Dependent from the distal extremity of the cover sheet 3 is a mesh or netting skirt 6 as hereinbefore described which is ideally prevented from flapping in the wind by a weighted hem 9. Protectors 8 as previously described may be provided to prevent wear on the material of the cover sheet 3 where it is in contact with the outer ends of the radial arms 2. Reinforcement 15 is provided in the form of second or further layers of material at the corners of the cover sheet 3.

Figure 2:
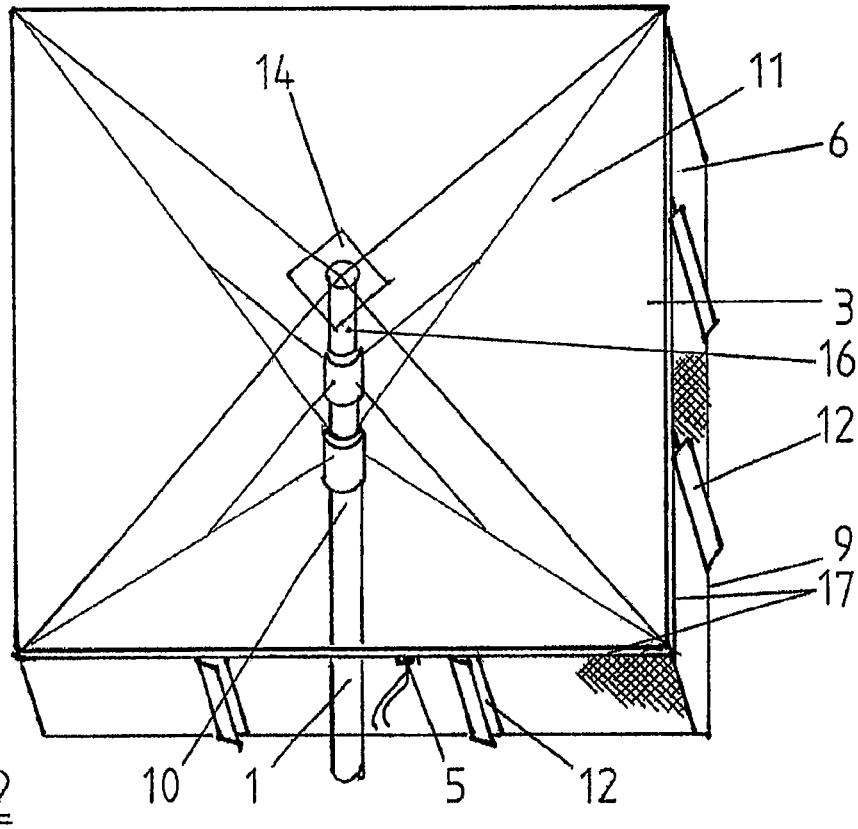
FIG. 2 shows an aerial view of the invention in place upon a typical four-Armed airer, distorted in order to show details of the skirt.

FIG. 2 shows the invention as seen from above, showing the central shaft 1 of the airer 10 surmounted by the central support 16 supporting the cover 11 in use. The cover sheet 3 is held in place upon the airer 10 by a drawstring or drawstrings 5 held in tension by known means. Dependent from the extremity of said cover sheet 3 is the mesh or netting skirt 6 finished in this case with a weighted hem 9. Said skirt 6 may equally be fashioned in segments and may be weighted by other means, e.g. by self-adhesive, pocketed or hooked weights. In certain cases it may be desirable to replace or supplement said drawstring or drawstrings 5 with one or more lengths of elastic 17 similarly displayed to facilitate attachment of the cover 11 to the rotary airer 10. Likewise, secondary securing means such as strings or lengths of material may be attached to the underside of the cover 11 at the corners, centrally or otherwise disposed upon said cover sheet 3 to attach the cover 11 securely to the airer. The skirt 6 may additionally be provided with vertical strips of material 12 to increase its rigidity, and said vertical strips 12 may be perpendicularly folded and formed in the shape of a Vee, thus permitting wind trapped thereby to exert a rotational force upon said rotary airer 10.

Figure 3:
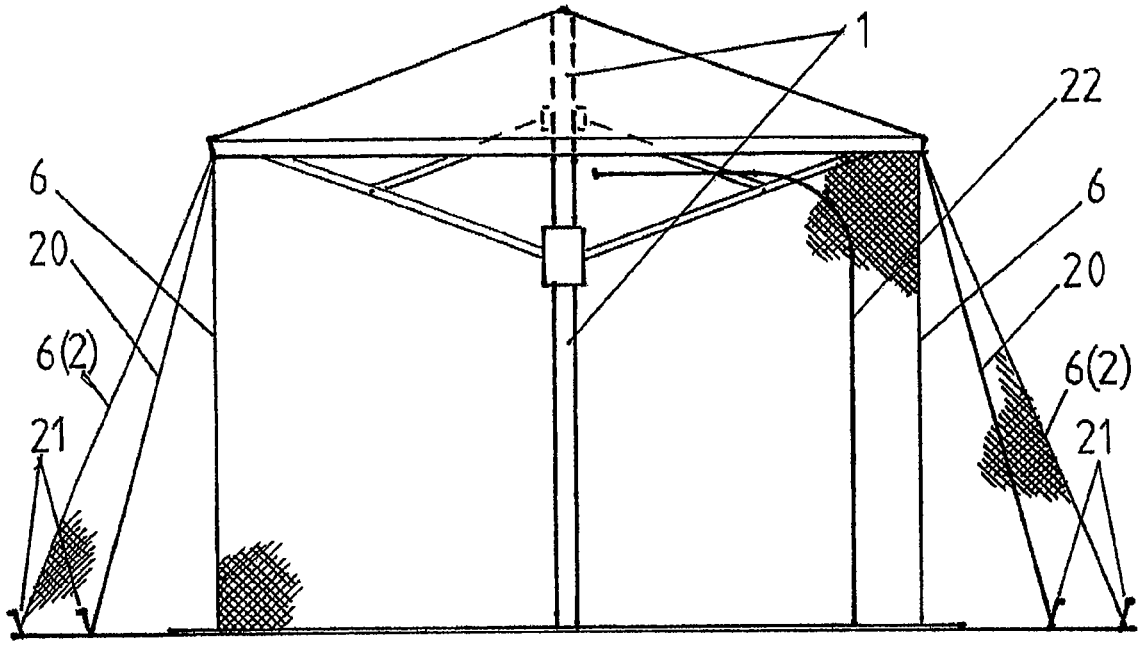
FIG. 3 shows a frontal view demonstrating the arrangement of a secure and insect proof airer and cover.

FIG. 3 shows a variation for use in tropical countries where it is desirable to exclude insects. This example shows the cover as described above, mounted upon a purpose built airer additionally equipped with an integral central shaft 1 extended to form the central supporting means 16 of FIGS. 1 and 2. It is further distinguished from the previous examples by the provision of guy ropes 20 and pegs 21 and a fine mesh skirt 6 extended to ground level and secured there by known means whatsoever. To permit access, a secure fastening such as a zip 22 is provided that will exclude insects when fastened. Said skirt may be fashioned to extend outwards at its base if desired to form a larger secure area which could even provide secure portable shelter against insects. This extension is shown as a fine mesh skirt 6(2) and held in place by pegs 21 or other known means with or without guy ropes 20.

The invention claimed is:

1. An outdoor clothes airer cover for an outdoor clothes airer having at least three radially-upwardly-extending arms between which extend an array of clothes lines, the outdoor clothes airer cover comprising:

a suitably shaped sheet of waterproof material dimensioned to extend radially above said clothes lines and beyond an end of each of said radially-upwardly-extending arms, the sheet having a reinforced central portion adapted to be supported centrally above the clothes airer;

a plurality of reinforcing layers adapted to reinforce the sheet where the sheet contacts each end of the radial arms;

a vent in the sheet for venting air from beneath the sheet;

a central support adapted to attach to a central shaft of the rotary airer and to raise the sheet above the end of each of said radially-upwardly-extending arms;

one or more cords providing peripheral drawstring for securing the sheet below the end of each of said radially-upwardly-extending arms of the airer; and a substantially vertically-oriented circumferential skirt of an air permeable netting material, the circumferential skirt integrally mounted to the sheet and the skirt having a hem weighted throughout its length.

2. An outdoor clothes airer cover as claimed in claim 1, wherein said waterproof material is resistant to Ultra Violet radiation.

3. An outdoor clothes airer cover as claimed in claim 1, wherein the drawstring comprises an elastic material.

4. An outdoor clothes airer cover as claimed in claim 1, wherein said skirt comprises vertical strips of a heavier material to provide increased rigidity, and wherein the vertical strips comprise Vee-shaped flaps oriented to promote rotation of the cover and the rotary airer when impacted by wind.

5. An outdoor clothes airer cover as claimed in claim 1, wherein said substantially vertically-oriented circumferential skirt is adapted to be secured to ground by guy ropes.

6. An outdoor clothes airer cover for as claimed in claim 5, wherein the skirt comprises an insect-proof entry.

7. An outdoor clothes airer cover as claimed in claim 1 wherein the central support comprises a lower extremity equipped with a variable external diameter.

8. An outdoor clothes airer cover as claimed in claim 1 wherein the central support further comprises a height adjustment.

9. An outdoor clothes airer cover as claimed in claim 1, wherein said skirt comprises strips of a heavier material to provide increased rigidity.

10. An outdoor clothes airer cover as claimed in claim 9, wherein the strips are vertical and adapted to exert a rotational force upon the rotary airer when impacted by wind.

11. An outdoor clothes airer cover as recited in claim 1, further comprising a plurality of guy ropes, each of the plurality of guy ropes attached to the end of one of said radially-upwardly-extending arms and secured to ground by one of spikes and pegs.

12. An outdoor rotary washing line airer having multiple splayed arms disposed equi-angularly about and supported centrally from a common central vertical post, and an outdoor clothes airer cover according to claim 1, the central post adapted to provide central support for the cover, and the cover engaging an extremity of each the arms and retained on the arms by the one or more cords.

13. A method of drying laundry comprising a step of mounting a damp laundry on the outdoor rotary washing line airer claimed in claim 12.

14. A method as recited in claim 13, wherein the washing line airer is adapted to rotate when impacted by wind, wherein the method further comprises allowing wind to rotate the airer to enhance drying of the clothes.

* * * * *

UNITED STATES PATENT AND TRADEMARK OFFICE

CERTIFICATE OF CORRECTION

PATENT NO. : 7,909,051 B2
APPLICATION NO. : 12/300039
DATED : March 22, 2011
INVENTOR(S) : Victory et al.

It is certified that error appears in the above-identified patent and that said Letters Patent is hereby corrected as shown below:

Title Page, in the PCT Filed: (22): Delete "May 15, 2005" and insert --May 15, 2007--

Signed and Sealed this
Seventeenth Day of May, 2011

David J. Kappos

David J. Kappos
*Director of the United States Patent and Trademark Office*